United States Patent [19]

Bullivant

[11] Patent Number: 4,659,256

[45] Date of Patent: Apr. 21, 1987

[54] PILES

[75] Inventor: Roger A. Bullivant, Burton-on-the-Trent, England

[73] Assignee: Roger Bullivant of Texas, Inc., Grand Prairie, Tex.

[21] Appl. No.: 825,087

[22] Filed: Jan. 31, 1986

[30] Foreign Application Priority Data

Feb. 2, 1985 [GB] United Kingdom ..... 8502709

[51] Int. Cl.[4] ..... E02D 27/48

[52] U.S. Cl. ..... 405/230; 405/229

[58] Field of Search ..... 405/230, 229, 227; 166/55.2, 55.3; 30/92, 103, 93, 94

[56] References Cited

U.S. PATENT DOCUMENTS

| | | | |
|---|---|---|---|
| 1,085,600 | 2/1914 | Goldsborough | 405/230 |
| 2,124,617 | 7/1938 | Greenawalt | 166/55.2 |
| 3,224,204 | 12/1965 | Siebenhausen | 405/227 |
| 3,786,641 | 1/1974 | Turzillo | 405/230 |
| 4,507,069 | 3/1985 | Murray et al. | 405/229 X |
| 4,563,110 | 1/1986 | Langenbach et al. | 405/230 |

FOREIGN PATENT DOCUMENTS

| | | |
|---|---|---|
| 396556 | 8/1933 | United Kingdom . |
| 2091313 | 7/1982 | United Kingdom . |
| 2094374A | 9/1982 | United Kingdom . |
| 2096675A | 10/1982 | United Kingdom . |
| 2170527A | 8/1986 | United Kingdom . |

*Primary Examiner*—Dennis L. Taylor

*Attorney, Agent, or Firm*—Richards, Harris, Medlock & Andrews

[57] ABSTRACT

A method of supporting a structure comprises driving a pile casing through a hold in a structure to be supported until the leading end of the pile casing reaches its desired position and thereafter introducing a cutter into the top of the pile casing, positioning a cutting element of said cutter to a location at or near the lower surface of the structure to be supported, actuating the cutter to cut off the pile above said location so that the unwanted top portion of the pile can then be removed and introducing concrete into the pile casing and hole through the structure.

14 Claims, 1 Drawing Figure

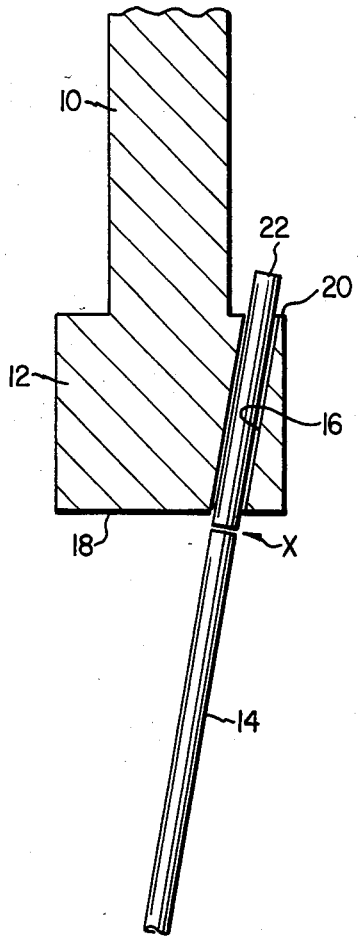
10
22
20
12
16
18
X
14

PILES

BACKGROUND OF THE INVENTION

In one well known form of piling, a hollow steel tubular pile casing is driven into position beneath a structure to be supported, by any suitable method, for example top or bottom driving. Normally, the pile is provided in a plurality of sections which, on fitment are interconnected to provide the pile casing. In most instances, a pile is driven until its tip reaches a rigid stratum or until the frictional forces on its side are sufficiently great to support the load intended to be held by the pile. This means that when using pile casing sections in predetermined lengths there is no guarantee that the uppermost pile casing section of the completed pile lies with its open top at the desired position. This desired position is just beneath the structure to be supported so that when concrete is poured into the pile casing to complete the pile, not only can the concrete fill the hole through the structure through which the pile casing has been driven, but also it can extrude into the small space between the top of the pile and the base of the structure to be supported to increase the reaction between the pile top and the structure.

It is an object of the present invention to obviate or mitigate this problem.

DISCLOSURE OF THE INVENTION

According to the present invention there is provided a method of supporting a structure comprising driving a pile casing through a hole in a structure to be supported until the leading end of the pile casing reaches its desired position and thereafter introducing a cutter into the top of the pile casing, positioning a cutting element of said cutter to a location at or near the lower surface of the structure to be supported, actuating the cutter to part or cut off the pile above said location so that said unwanted top portion of the pile can then be removed and introducing concrete into the pile casing and hole through the structure.

Preferably the cutting may be carried out by a rotary mechanical cutter having a cutting blade. Alternatively, the cutter may be a spark eroder or a gas flame.

BRIEF DESCRIPTION OF THE DRAWING

An embodiment of the present invention will now be described, by way of example only, with reference to the accompanying drawing, which shows diagrammatically a cross-section through a foundation of a building to be supported by a pile and the upper section of a pile casing of the pile for supporting the building.

DETAILED DESCRIPTION

A building comprises an external wall 10 carried by a concrete foundation 12. The building in this embodiment is an existing or new building which has to be supported by at least one pile 14 driven through a hole 16, which is normally cut through the foundation 12 by a rotary percussive drill at an angle close to the vertical. During the drilling of the hole 16 careful note is made of the depth of the foundation at that particular point, that is the length of the drill which has penetrated the foundation 12 when it breaks through the lower surface of the foundation.

The pile is then formed by driving tubular pile casing sections through the passage 16 either by a top driving technique so that the pile sections are driven one by one from alongside the wall 10 or by a bottom driving technique where a pneumatic mole is fitted to the lowermost section of the pile and drags subsequent pile sections 14 attached to it down the hole. Whatever pile driving technique is employed, it is terminated when the pile casing reaches its desired position, for example when the base of the lowermost pile section abuts a base rock or alternatively when the forces of friction on the pile casings are equal to or greater than the calculated load to be supported by the pile. It will be realized that as the pile casing comprises a number of longitudinally interconnected equal length sections, when it assumes its final position the top end of the uppermost section will probably not occupy the desired position, that is just below the lowermost surface 18 of the foundation 12. In the embodiment illustrated, the uppermost pile casing section terminates above the upper face 20 of the foundation 12.

To ensure that the uppermost end of the final pile casing occupies the optimum desired position X illustrated in the drawing, that is just below the lower face of the foundation 12, when driving has ceased careful measurement of the length of pile casing projecting above the upper face 20 of the foundation 12 is taken and this, together with the reading taken during the drilling operation, is used to determine what length of casing has to be parted or cut off from the end of the positioned casing so that the upper end of the final casing is at the position X. Thereafter, an internal cutting machine is fitted into the interior of the pile casing and when the cutting arrangement of the machine is arranged alongside the position X, it is actuated to part or cut off the upper section 22 of the casing. The excess section 22 can then be pulled out of the passage 16 and the pile can be filled with concrete in the normal way, further concrete being poured after the pile has been filled such that it fills also the passage 16 and those regions in the area of position X on the underside of the foundation 12 into which it can penetrate.

Various modifications can be made without departing from the scope of the invention. For example, a single length of pile casing can be utilized, if appropriate, rather than a sectional pile casing. The cutting means employed for parting off the unwanted upper end of the pile casing may be mechanical means involving a rotary cutting blade, spark erosion means or flame cutting mean. The concrete can be poured at atmospheric pressure but preferably is inserted into the pile casing 14 and the passage 16 under pressure. In a further modification, the location of position X may be varied as desired. For example, it may be anywhere within the passage 16.

It will be realized also that the present invention can be readily utilized when piling a new building having pile holes cut or preformed in the foundation or through the floor slab.

Whilst endeavouring in the foregoing specification to draw attention to those features of the invention believed to be of particular importance, it should be understood that the Applicant claims protection in respect of any patentable feature or combination of features hereinbefore referred to whether or not particular emphasis has been placed thereon.

I claim:

1. A method of supporting a structure comprising:

driving a pile casing through a hole in the structure to be supported until the leading end of the pile casing reaches a desired position, and introducing a cutter into the top of the pile casing and positioning a cutting element of said cutter at a location at or near the lower surface of the structure to be supported, actuating the cutter to cut off the pile casing above said location so that the top portion of the pile can be removed, and introducing concrete into the pile casing and hole through the structure.

2. The method of claim 1 wherein the cutting is carried out by a rotary mechanical cutter having a cutting blade.

3. The method of claim 1 wherein the cutting is carried out by a rotary spark eroder.

4. The method of claim 1 wherein the cutting is carried out by a rotary flame cutter.

5. The method of claim 1 wherein the cutting is carried out by a hot wire cutter.

6. The method of claim 1 wherein the cutting is carried out by an explosive cutter.

7. The method of claim 1 wherein the cutting is carried out by an expanding jaw cutter.

8. A method of supporting a structure comprising:

driving a pile casing to a desired depth below the structure, introducing a cutter into the top of the pile casing to position a cutting element of said cutter at a desired location relative to the structure, actuating the cutter to cut the pile casing at said location, removing the upper portion of the pile casing cut of above said location, and introducing a cementitious material into the pile casing and between said location and structure.

9. The method of claim 8 wherein the cutting is carried out by a rotary mechanical cutter having a cutting blade.

10. The method of claim 8 wherein the cutting is carried out by a rotary spark eroder.

11. The method of claim 8 wherein the cutting is carried out by a rotary flame cutter.

12. The method of claim 8 wherein the cutting is carried out by a hot wire cutter.

13. The method of claim 8 wherein the cutting is carried out by an explosive cutter.

14. The method of claim 8 wherein the cutting is carried out by an expanding jaw cutter.

* * * * *